US007017777B1

(12) United States Patent
Dixon

(10) Patent No.: US 7,017,777 B1
(45) Date of Patent: Mar. 28, 2006

(54) AUTOMATED VENDING MACHINE

(76) Inventor: Carolyn S. Dixon, 231 High St., Conneaut, OH (US) 44030

( * ) Notice: Subject to any disclaimer, the term of this patent is extended or adjusted under 35 U.S.C. 154(b) by 247 days.

(21) Appl. No.: 10/640,766

(22) Filed: Aug. 15, 2003

(51) Int. Cl.
*A24F 15/04* (2006.01)

(52) U.S. Cl. ..... 221/24; 221/155; 221/90

(58) Field of Classification Search ..... 221/24, 221/255, 69, 82, 89, 123, 124, 133, 131
See application file for complete search history.

(56) References Cited

U.S. PATENT DOCUMENTS

| | | | | | |
|---|---|---|---|---|---|
| 1,741,000 | A | * | 12/1929 | Roberts | 221/232 |
| 2,474,744 | A | * | 6/1949 | Lambert | 221/107 |
| 3,126,124 | A | * | 3/1964 | Katz et al. | 221/90 |
| 3,196,276 | A | * | 7/1965 | Naab | 250/223 R |
| 4,005,801 | A | * | 2/1977 | Musser | 221/56 |
| 4,090,637 | A | * | 5/1978 | Williamson | 221/92 |
| 4,359,631 | A | | 11/1982 | Lockwood et al. | |
| RE32,115 | E | | 4/1986 | Lockwood et al. | |
| 4,579,213 | A | * | 4/1986 | Rhine et al. | 194/217 |
| 4,668,150 | A | | 5/1987 | Blumberg | |
| 5,159,560 | A | | 10/1992 | Newell et al. | |
| 5,875,110 | A | | 2/1999 | Jacobs | |
| 5,923,906 | A | | 7/1999 | Zander | |
| 6,241,151 | B1 | | 6/2001 | Swaine et al. | |
| 6,323,894 | B1 | | 11/2001 | Katz | |
| D468,361 | S | | 1/2003 | Ainscough | |
| 2003/0042268 | A1 | * | 3/2003 | Srinivasan et al. | 221/24 |

* cited by examiner

*Primary Examiner*—Kenneth Noland

(57) ABSTRACT

An automated vending machine is adapted to vend vacation-related goods. The vending machine is constructed as an enlarged reproduction of a conventional traffic control signal. The vending machine includes a rectangular enclosure in which is housed a storage and vending assembly. The enclosure includes a plurality of illuminated, colored lamps. A plurality of circular cavities are provided for visually displaying goods. A coin and bill counter with coin return is provided for receiving a customer's consideration. The vending machine further includes a dispensing chute having a discharge hopper into which goods are delivered. A plurality of push-buttons facilitate communication between a customer and internal circuitry of the storage and vending assembly to facilitate dispensing of a good selected by customer after correct amount of consideration is inserted in coin and bill counter.

12 Claims, 5 Drawing Sheets

AUTOMATED VENDING MACHINE

RELATED APPLICATIONS

The present invention was first described in Disclosure Document Registration 526,799 filed on Feb. 24, 2003 under 35 U.S.C. §122, 37 C.F.R. §1.14, and MPEP §1706. There are no previously filed, nor currently any co-pending applications, anywhere in the world.

BACKGROUND OF THE INVENTION

1. Field of the Invention

The present invention relates generally to vending machines, and more particularly to an automated vending machine resembling an enlarged reproduction of a traditional traffic control signal adapted to vend vacation-related goods.

2. Description of the Related Art

In vacation-oriented travel, people routinely forget to pack certain vacation-related items that only after having already departed or arrived at their destination is this dilemma realized. In addition, locating a particular store carrying vacation-related items such as maps, disposable cameras, 35 mm camera film, sunglasses, binoculars, ball caps, sunscreen, and sun visors can be difficult, especially if one is unfamiliar with the geographic area. Furthermore, finding an individual store supplying all of the aforementioned items is unlikely, not to mention valuable vacation time wasted on searching for these items. Moreover, conventional vending machines generally dispense only food and beverage products and fail to incorporate a vending machine with ornamental housing which dispenses goods having an identifiable grouping or theme which require unique handling.

Accordingly, a need has arisen for a means to dispense vacation-related goods via a vending machine which resembles a particular identifiable object being dominated by object's general character. The development of the automated vending machine fulfills this need.

A search of the prior art did not disclose any patents that read directly on the claims of the instant invention; however, the following references were considered related:

U.S. Pat. No. 6,241,151, issued in the name of Swain et al., describes a self-service terminal of the type adaptable for use with an ATM machine.

U.S. Pat. No. 6,323,894, issued in the name of Katz, describes a commercial product routing system with video vending capability.

U.S. Pat. No. 5,923,906, issued in the name of Zander, describes a photograph vending device.

U.S. Pat. No. D468,361, issued in the name of Ainscough, describes an ornamental design for a camera vending machine.

U.S. Pat. No. 4,359,631 and Reissue Pat. No. RE32,115, issued in the name of Lockwood et al, describe a self service terminal for dispensing voice and video information.

U.S. Pat. No. 4,668,150, issued in the name of Blumberg, discloses a vending machine for video cassettes.

U.S. Pat. No. 5,875,110, issued in the name of Jacobs, describes an interactive, sequentially prompting vending machine.

U.S. Pat. No. 5,159,560, issued in the name of Newll et al, describes an automated merchandise dispensing and retrieval system.

SUMMARY OF THE INVENTION

Therefore, it is an object of the present invention to provide a vending machine adapted to vend vacation-related goods.

It is another object of the present invention to provide a vending machine which resembles an enlarged reproduction of a traditional traffic control signal.

It is another object of the present invention to provide a vending machine having a plurality of illuminated, colored lamps aligned in a vertical series.

It is another object of the present invention to provide a vending machine with illuminated lamps which emit red, yellow, and green colors.

It is another object of the present invention to provide a plurality of circular cavities each with a protective, transparent shield through which goods to be dispensed can be seen.

It is still another object of the present invention to provide a coin and bill counter with coin return located lateral to circular cavities for receiving customer's consideration.

It is another object of the present invention to provide a dispensing chute which leads into a discharge hopper into which goods are delivered.

It is another object of the present invention to provide a dispensing chute lined with a frictional engagement layer adapted to slightly arrest the speed of good's downward slide, thereby affording the product with protection against damage or breakage.

It is another object of the present invention to provide a plurality of push-buttons to facilitate communication between a customer and internal circuitry of the storage and vending assembly.

Briefly described according to one embodiment of the present invention, an automated vending machine is adapted to vend vacation-related goods. The vending machine is constructed as an enlarged reproduction of a traditional traffic control signal having a plurality of colored lights. The vending machine includes a generally rectangular enclosure in which is housed a storage and vending assembly. A front panel and back panel of enclosure are each provided with a plurality of illuminated, colored lamps aligned in a vertical series along a linearly elongated centerline thereof. The upper lamp emits a red illumination, the middle lamp emits a yellow illumination, and the lower lamp emits a green illumination in order to more closely coincide with a traditional traffic control signal.

A plurality of circular cavities for housing goods are aligned in a linear fashion. Each circular cavity is provided with a protective, transparent shield through which goods to be dispensed from the vending machine can be seen. A coin and bill counter with coin return is located lateral to circular cavities for receiving a customer's consideration.

A dispensing chute, which includes a discharge hopper into which goods are delivered, is lined with a frictional engagement layer adapted to slightly arrest the speed of good's downward slide, thereby affording it with protection against damage or breakage. A plurality of push-buttons facilitate communication between a customer and internal circuitry of the storage and vending assembly. Each push-button is labeled with an alphanumeric character being correlative to a same alphanumeric character displayed by a particular good housed within a circular cavity, thus facilitating the transaction of dispensing a good selected by customer after correct amount of consideration is inserted in coin and bill counter.

A rigid frame is located inside rectangular enclosure atop planar floor and provides a support base for the storage and vending assembly. The storage and vending assembly comprises a storage bin having a plurality of inclined chutes for storably stacking and guiding goods until actuated for dispense. Each inclined chute utilizes a trap door which is provided with an electromechanical latch, wherein latch has a spring-biased latch plunger which resides within a latch shaft. The latch plunger is electrically connected for rotatable reciprocation by a second motor. The second motor is operable to actuate rotatable retraction of latch plunger and then release latch plunger.

An electrical connector module is placed in electrical communication between push buttons and second motor, wherein electrical connector module has a plurality of contacts. The latch shaft carries a corresponding plurality of contact elements for engaging contacts of connector module when second motor actuates rotatable retraction of latch plunger, thereby facilitating downward release of trap door and transference of a selected good into a receptacle of a pivotal loading arm. The pivotal loading arm pivots in a sweeping manner to a position being frontal to dispensing chute, down the face of which selected good slides in a controlled manner until resting in discharge hopper.

The use of the present invention allows for the automatic dispensing of vacation-related goods via a vending machine which resembles a particular identifiable object being dominated by object's general character.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

1. Detailed Description of the Figures

Figure 1:
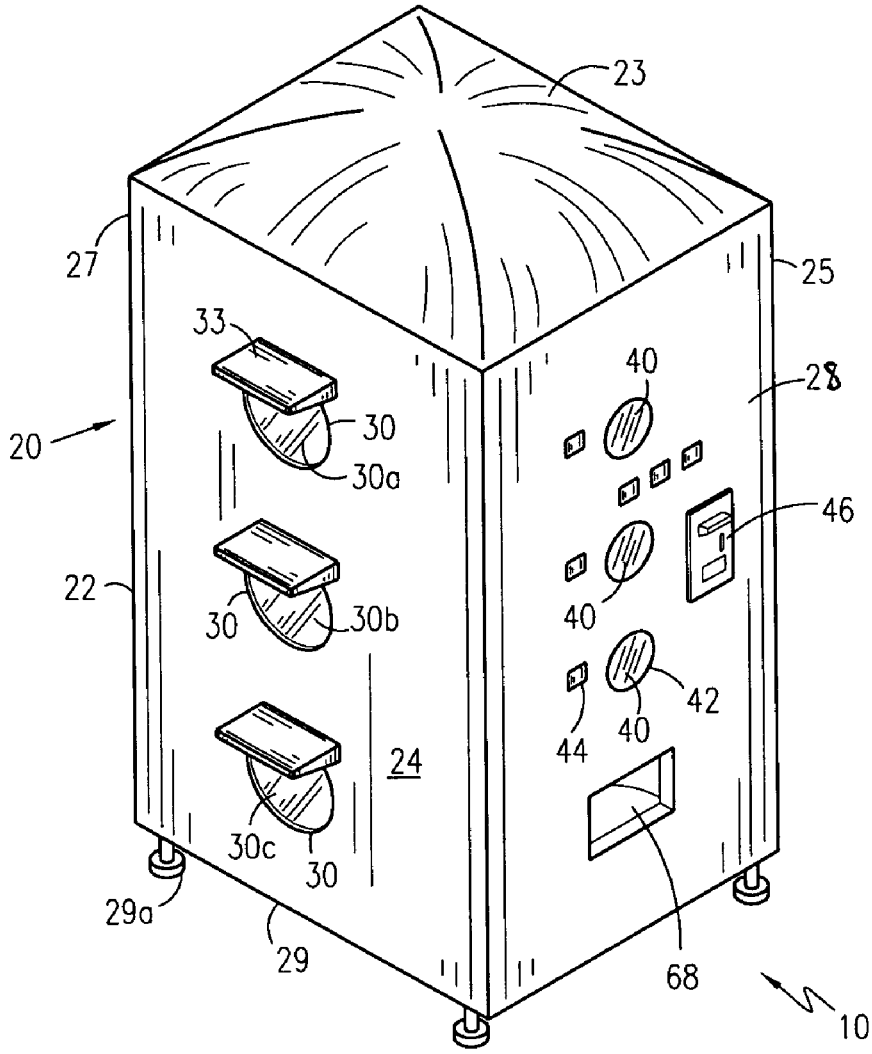
FIG. 1 is a perspective view of an automated vending machine according to the preferred embodiment of the present invention.
Figure 2:
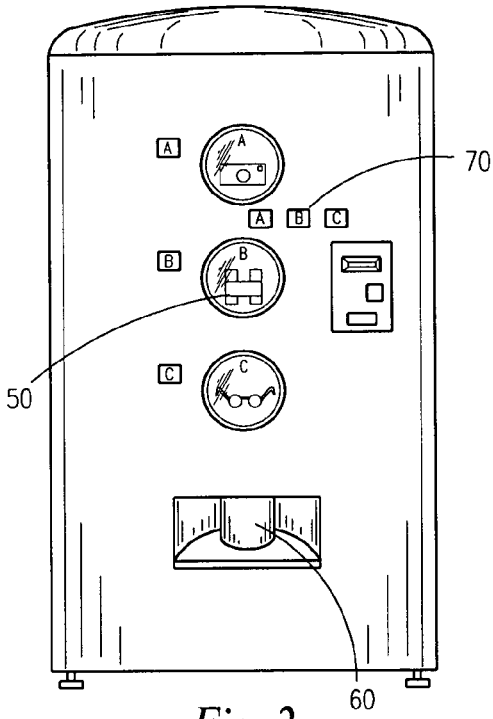
FIG. 2 is a side elevational view thereof.
Figure 3:
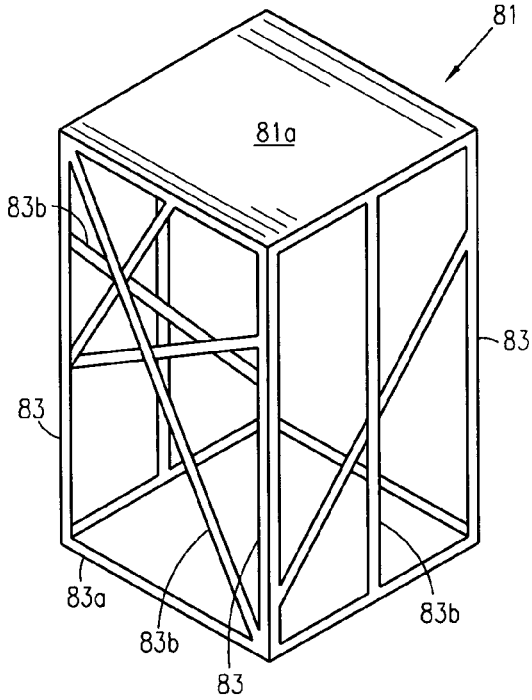
FIG. 3 is perspective view of the rigid frame according to the preferred embodiment of the present invention.
Figure 4:
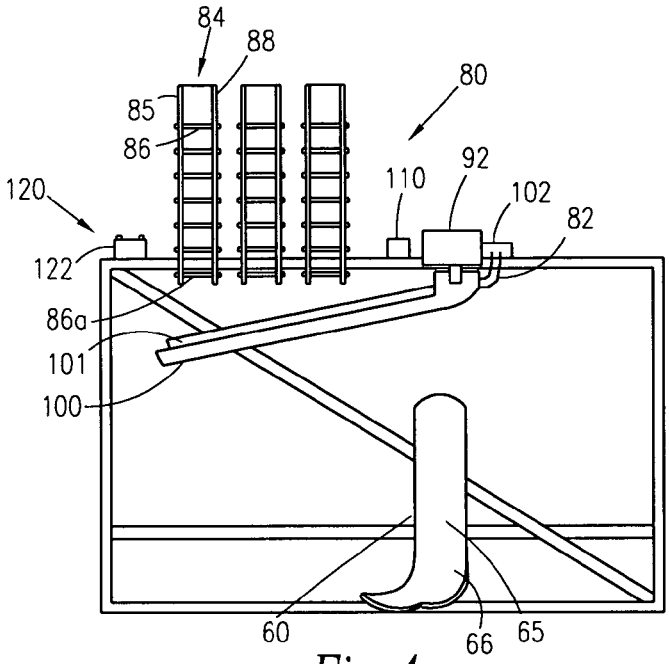
FIG. 4 is a side elevational view of the storage and vending assembly according to the preferred embodiment of the present invention.
Figure 5:
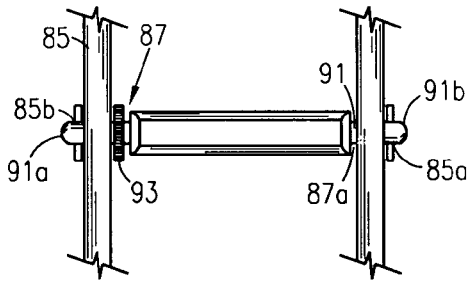
FIG. 5 is a front side elevational view of a trap door and electromechanical latch according to the preferred embodiment of the present invention.
Figure 6:
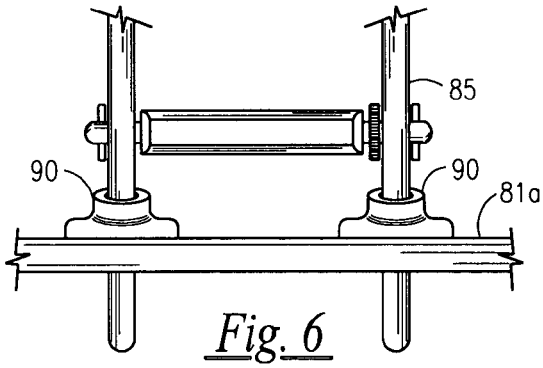
FIG. 6 is a rear elevational view showing support brackets for mounting inclined chutes according to the preferred embodiment of the present invention.
Figure 7:
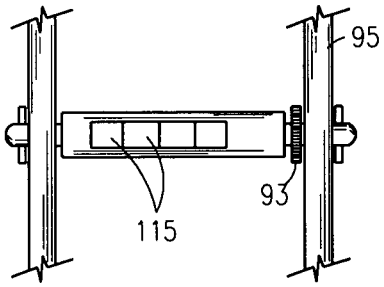
FIG. 7 is a rear elevational view of the plurality of contact elements of the trap door according to the preferred embodiment of the present invention.
Figure 8:
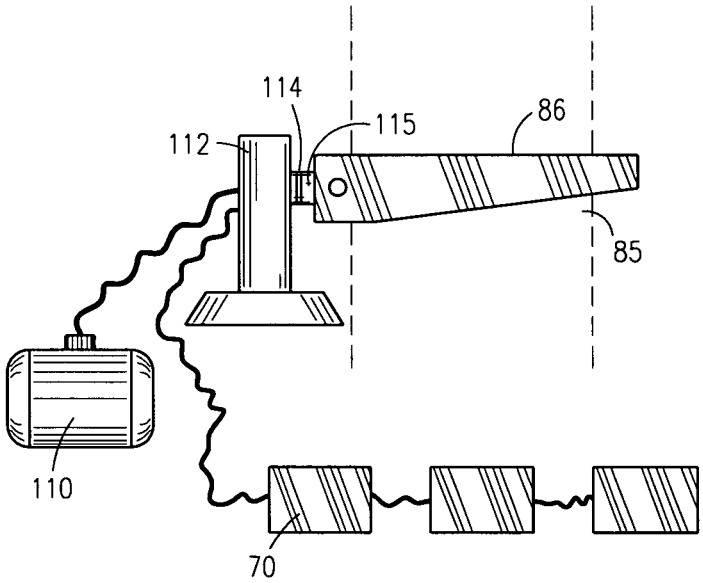
FIG. 8 is a side elevational view of the electrical connector module shown placed in electrical communication between push buttons and second motor according to the preferred embodiment of the present invention.

Referring now to FIGS. 1, 2, and 4, an automated vending machine 10 is shown, according to the present invention, adapted to vend vacation-related goods 50. For purposes of this disclosure, vacation-related goods are defined as including but not limited to maps, disposable cameras, 35 mm camera film, sunglasses, binoculars, ball caps, sunscreen, and sun visors.

The automated vending machine 10, hereinafter machine 10, is constructed to correspond to or resemble a particular identifiable object being dominated by object's general character. The preferred embodiment is directed to a traffic light 20 illustrated as an enlarged reproduction of a traditional traffic control signal having a plurality of colored lights. The machine 10 includes a generally rectangular enclosure 22 in which is housed a storage and vending assembly 80 (to be described in greater detail below). The exterior of the enclosure 22 defines a concave top 23 opposing a planar floor 29. A front panel 24 opposes a back panel 25, wherein front panel 24 and back panel 25 extend upwardly from floor 29 and join top 23. The exterior of the enclosure 20 further defines a first side panel 27 which opposes a second side panel 28, wherein first side panel 27 and second side panel 28 extend upwardly from floor 29 and join top 23. It is envisioned that the lower surface of the floor 29 is provided with a plurality of vertically adjustable, non-skid feet 29*a*, wherein each foot 29*a* is located along each corner of floor 29 in order to facilitate stability and balance of the machine 10, as well as to prevent mobility thereof.

The front panel 24 and back panel 25 are each provided with a plurality of illuminated, colored lamps 30 aligned in a vertical series along a linearly elongated centerline thereof. The lamps 30 are shown herein as three in number, and are electrically connected to a power source 120, wherein power source 120 is shown herein as a battery 122. Preferably, the upper lamp 30*a* emits a red illumination, the middle lamp 30*b* emits a yellow illumination, and the lower lamp 30*c* emits a green illumination in order to more closely coincide with a traditional traffic control signal. Each lamp 30*a*, 30*b*, and 30*c* is shaded with a hood 33.

The second side panel 28 includes a plurality of circular cavities 40 for housing goods 50. The circular cavities 40 are shown herein as being aligned in a linear fashion and total three in number, however, it is recognized that various other arrangements and number of cavities 40 are contemplated, and therefore, the alignment of the cavities 40 as shown herein is not intended to be a limiting factor. Each circular cavity 40 is provided with a protective, transparent shield 42 through which goods 50 to be dispensed from the machine 10 can be seen. It is envisioned that the shield 42 is constructed of plexiglass.

Adjacent to each circular cavity 40 rests a price tag 44 to indicate the cost of a particular good 50. A coin and bill counter 46 with coin return is provided along the second side panel 28 being lateral to circular cavities 40 for receiving a customer's consideration. It is envisioned that coin and bill counter 46 may be supplemented or supplanted with a credit card reader apparatus or the like.

A dispensing chute 60, which includes a discharge hopper 68 into which goods 50 are delivered, is located along a lower portion of second side panel 28.

A plurality of push-buttons 70 facilitate communication between a customer and internal circuitry 82 of the storage and vending assembly 80 which is housed inside machine 10. For purposes of this disclosure, three push-buttons 70 are illustrated in order to correspond to and function with three selectable goods 50. Each push-button 70 is labeled with an alphanumeric character 72 being correlative to a same alphanumeric character 72 displayed by a particular good 50 housed within a circular cavity 40, thus facilitating the transaction of dispensing a good 50 selected by customer after correct amount of consideration is inserted in coin and bill counter 46.

Referring now to FIGS. 1 and 3–8, a rigid frame 81 is located inside rectangular enclosure 22 atop planar floor 29 and provides a support base for the storage and vending assembly 80. The rigid frame 81 comprises a support plate 81*a* supported horizontally by a plurality of vertical supports 83 and base support 83*a*. A plurality of cross members 83*b* are provided to enhance structural rigidity of the rigid frame 81. The storage and vending assembly 80 comprises a storage bin 82 having a plurality of inclined chutes 84 for storably stacking and guiding goods 50 until actuated for dispense. The preferred embodiment is shown herein as having three inclined chutes 84; however, it is recognized that the number of chutes 84 and their dimensions can be of an increased or decreased size according to a particularly desired application. The chutes 84 are each defined as an open-faced, open top, rectangular frame, having two parallel sides 85 joined by a plurality of spring-biased, hinged trap doors 86 aligned in linear series. The chutes 84 are suitably mounted inside machine 10 atop support plate 81*a* of rigid frame 81 via a plurality of vertical support brackets 90.

A loading arm support member 92, mounted to an upper and underside of the support plate 81*a* of rigid frame 81, rotatably supports a pivotal loading arm 100 below loading arm support member 92. The pivotal loading arm 100 is rotatably supported at a slightly downward angle. The pivotal loading arm 100 pivots below each trap door 86 of each chute 84 and is electrically connected to a first motor 102 which functions to swing the pivotal loading arm 100 away from bottom trap doors 86*a* to a dispensing position being frontal to dispensing chute 60, and back to the bottom trap doors 86*a*. Each trap door 86 includes an electromechanical latch 87 comprised of a spring-biased latch plunger 91 which resides within a latch shaft 87*a*. The latch plunger 91 is supported by opposed ends 91*a*, 91*b* which extend through opposed plunger apertures 85*a*, 85*b* formed in the two parallel sides 85 of each chute 84. The latch plunger 91 is electrically connected for rotatable reciprocation by a second motor 110. The second motor 110 is operable to actuate rotatable retraction of latch plunger 91 away from plunger aperture 85*a* and then to release latch plunger 91.

An electrical connector module 112 is placed in electrical communication between push buttons 70 and second motor 110, wherein electrical connector module 112 has a plurality of contacts 114. The latch shaft 87*a* carries a corresponding plurality of contact elements 115 for engaging contacts 114 when second motor 110 actuates rotatable retraction of latch plunger 91 away from plunger aperture 85*a* thereby facilitating downward release of trap door 86 and transference of a selected good 50 into a receptacle 101 of pivotal loading arm 100. The latch plunger 91 includes a spring 93 mounted thereto which spring urges trap door 86 upwardly to a perpendicular stacking position upon transference of selected good 50 into the receptacle 101. The pivotal loading arm 100 pivots in a sweeping manner to a position being frontal to dispensing chute 60, down the face of which selected good 50 slides in a controlled manner until resting in discharge hopper 68. The connector module 112 provides power to communicate information emitted thereto via a selected push button 70 to a corresponding inclined chute 84 and to communicate information facilitating release of each trap door 86 within a corresponding inclined chute 84 in a sequentially ordered manner until release of a selected good 50 is effectuated.

The dispensing chute 60 is of a generally arcuate shape having a channel 65 defining the face thereof. In order to facilitate controlled delivery of a selected good 50 down chute 60 thereby affording it with protection against damage or breakage, the channel 65 is lined with a frictional engagement layer 66 adapted to slightly arrest the speed of good's 50 downward slide.

Figure 9:
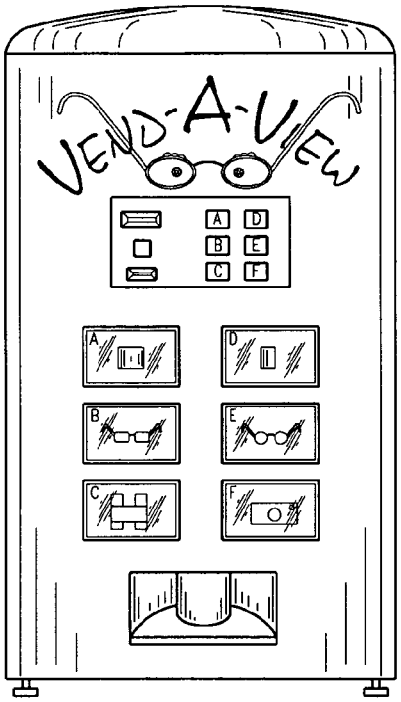
FIG. 9 illustrates an alternate embodiment of the present invention.
Figure 10:
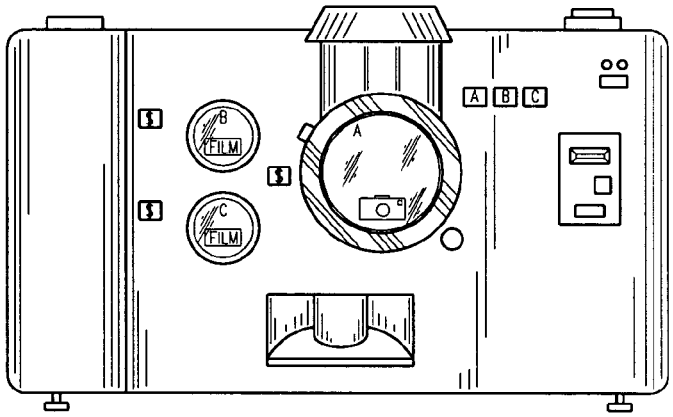
FIG. 10 illustrates another alternate embodiment of the present invention.

FIGS. 9 and 10 illustrate alternate embodiments of the present invention which incorporate the internal circuitry 82 and the vending assembly 80 as described in the aforementioned, however, the embodiment represented in FIG. 9 is not intended to be limited to three inclined chutes as described in the preferred embodiment. FIG. 9 depicts a vending machine with an enclosure exhibiting a caricature wearing glasses. FIG. 10 depicts a vending machine with an enclosure illustrating an enlarged reproduction of a traditional camera.

2. Operation of the Preferred Embodiment

To use the present invention, the customer selects a desired good 50 displayed through protective, transparent shields 42 of circular cavities 40. Customer then inserts the correct amount of consideration in coin and bill counter 46, and presses a corresponding push-button 70 which is labeled with an alphanumeric character 72 being correlative to a same alphanumeric character 72 displayed by a particular good 50 housed within a circular cavity 40. Depression of push-button 70 actuates the storage and vending assembly 80 to dispense the selected good 50 to the discharge hopper 68 where it is acquired by customer.

The use of the present invention allows for the automatic dispensing of vacation-related goods via a vending machine which resembles a particular identifiable object being dominated by object's general character.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be broadly limited only by the following claims.

What is claimed is:

1. An automated vending machine for vending vacation-related goods, said machine comprising:

a generally rectangular enclosure; said enclosure is constructed to correspond to or resemble a particular identifiable object being dominated by object's general character; wherein said enclosure has an exterior defining a concave top which opposes a planar floor, said enclosure further having a front panel which opposes a back panel, wherein said front panel and said back panel extend upwardly from said floor to join said concave top, and wherein said exterior defines a first side panel which opposes a second side panel, said first side panel and said second side panel extend upwardly from said floor to join said concave top;

wherein said front panel and said back panel are each provided with a plurality of illuminated, colored lamps aligned in a vertical series along a linearly elongated centerline of each of said front panel and said back panel, wherein said lamps are electrically connected to a power source;

a storage and vending assembly, said storage and vending assembly is housed inside said enclosure; and a rigid frame, said rigid frame is located inside said enclosure and provides a support base for said storage and vending assembly.

2. The machine of claim 1, wherein said second side panel includes a plurality of circular cavities for housing vacation-related goods, said circular cavities are aligned in a linear fashion, wherein each of said plurality of circular cavities is provided with a protective, transparent shield through which vacation-related goods to be dispensed from said machine can be seen.

3. The machine of claim 1, wherein said second side panel has a lower portion at which a dispensing chute is located, said dispensing chute includes a discharge hopper into which vacation-related goods are delivered.

4. The machine of claim 1, wherein said rigid frame is located atop said floor inside said rectangular enclosure, said rigid frame comprises a support plate supported horizontally by a plurality of vertical supports and a base support, and wherein said rigid frame further comprises a plurality of cross members which enhance structural rigidity of said rigid frame.

5. The machine of claim 1, wherein said storage and vending assembly comprises:

a storage bin having a plurality of inclined chutes for storably stacking and guiding vacation-related goods until actuated for dispense, said plurality of inclined chutes are each defined as an open-faced, open top, rectangular frame, having two parallel sides joined by a spring-biased, hinged trap door, said spring-biased, hinged trap door is pluralistic and aligned in linear series, and wherein said plurality of inclined chutes are suitably mounted inside said enclosure atop said support plate of said rigid frame via a plurality of vertical support brackets;

a loading arm support member is mounted to an upper and underside of said support plate of said rigid frame, said loading arm support member rotatably supports a pivotal loading arm below said loading arm support member, said pivotal loading arm is rotatably supported at a slightly downward angle, said pivotal loading arm pivots below each said hinged trap door and is electrically connected to a first motor which functions to swing said pivotal loading arm away from each bottom trap door to a dispensing position being frontal to said dispensing chute, and back to each said bottom trap door.

6. The machine of claim 2, wherein said second side panel further includes a price tag resting adjacent to each said circular cavity, said price tag indicates a cost of a particular vacation-related good, said second side panel having a coin and bill counter with coin return located lateral to said circular cavities for receiving a customer's consideration, said second side panel having a plurality of push-buttons facilitate communication between the customer and internal circuitry, wherein each of said plurality of push-buttons is labeled with an alphanumeric character being correlative to a same alphanumeric character displayed by a particular vacation-related good housed within said circular cavity, thus facilitating a transaction of dispensing a vacation-related good selected by the customer after a correct amount of consideration is inserted in said coin and bill counter.

7. The machine of claim 5, wherein each said trap door includes an electromechanical latch comprised of a spring-biased latch plunger which resides within a latch shaft, said latch plunger is supported by opposed ends which extend through opposed plunger apertures formed in said parallel sides of each said inclined chute, said latch plunger is electrically connected for rotatable reciprocation by a second motor, wherein said second motor is operable to actuate rotatable retraction of said latch plunger away from a plunger aperture of said opposed plunger apertures and then to release said latch plunger.

8. The machine of claim 7, wherein said second motor and said plurality of push buttons have an electrical connector module placed in electrical communication therebetween, said electrical connector module has a plurality of contacts, wherein said latch shaft carries a corresponding plurality of contact elements for engaging said plurality of contacts when said second motor actuates rotatable retraction of said latch plunger away from said plunger aperture thereby facilitating downward release of said bottom trap door and transference of a selected vacation-related good into a receptacle of said pivotal loading arm, said latch plunger includes a spring mounted thereto which spring urges said bottom trap door upwardly to a perpendicular stacking position upon transference of selected vacation-related good into said receptacle, and wherein said pivotal loading arm pivots in a sweeping manner to a position being frontal to said dispensing chute, and down said dispensing chute along which a selected vacation-related good slides, said electrical connector module provides power to communicate information emitted thereto via a selected push button to a corresponding said inclined chute and to communicate information facilitating release of each said trap door within a corresponding said inclined chute in a sequentially ordered manner until release of a selected vacation-related good is effectuated.

9. The machine of claim 1 wherein said floor has a lower surface provided with a plurality of vertically adjustable, non-skid feet, wherein each foot of said plurality of vertically adjustable, non-skid feet is located along each corner of said floor in order to facilitate stability and balance of said machine, as well as to prevent mobility thereof.

10. The machine of claim 1, wherein said plurality of illuminated, colored lamps define an upper lamp which emits a red illumination, a middle lamp which emits a yellow illumination, and a lower lamp which emits a green illumination in order to more closely coincide with the traditional traffic control signal, and wherein said upper lamp, said middle lamp, and said lower lamp is shaded with a hood.

11. The machine of claim 1, wherein said power source is a battery.

12. The machine of claim 3, wherein said dispensing chute is of a generally arcuate shape having a channel defining a face thereof, said channel is lined with a frictional engagement layer adapted to slightly arrest a speed of vacation-related good's downward slide, thereby facilitating controlled delivery of a selected vacation-related good down said dispensing chute so as to afford the vacation-related good with protection against damage or breakage.

* * * * *